US008656589B2

(12) United States Patent
Kurt-Elli

(10) Patent No.: US 8,656,589 B2
(45) Date of Patent: Feb. 25, 2014

(54) AEROFOIL ASSEMBLY AND A METHOD OF MANUFACTURING AN AEROFOIL ASSEMBLY

(75) Inventor: Hilmi Kurt-Elli, Derby (GB)

(73) Assignee: Rolls-Royce PLC, London (GB)

( * ) Notice: Subject to any disclaimer, the term of this patent is extended or adjusted under 35 U.S.C. 154(b) by 1142 days.

(21) Appl. No.: 11/647,441

(22) Filed: Dec. 29, 2006

(65) Prior Publication Data

US 2007/0175032 A1 Aug. 2, 2007

(30) Foreign Application Priority Data

Jan. 31, 2006 (GB) ..... 0601837.8

(51) Int. Cl.
*F01D 5/10* (2006.01)

(52) U.S. Cl.
USPC ..... 29/889.2; 29/889.23; 29/402.18

(58) Field of Classification Search
USPC ..... 29/889.2, 889.23, 402.06, 402.18, 402, 29/6, 402.09, 402.11, 402.21
See application file for complete search history.

(56) References Cited

U.S. PATENT DOCUMENTS

| | | | | |
|---|---|---|---|---|
| 3,758,233 | A | 9/1973 | Cross et al. | |
| 4,924,706 | A * | 5/1990 | Moore | 73/579 |
| 6,022,194 | A * | 2/2000 | Amos et al. | 416/219 R |
| 6,042,338 | A * | 3/2000 | Brafford et al. | 416/203 |
| 6,059,533 | A | 5/2000 | Stoker et al. | |
| 6,668,651 | B2 * | 12/2003 | Beausseroy et al. | 73/579 |
| 2004/0175260 | A1 | 9/2004 | Berthillier et al. | |
| 2005/0042384 | A1 | 2/2005 | Benedetti et al. | |
| 2005/0220615 | A1 * | 10/2005 | Martin et al. | 415/208.1 |
| 2005/0249586 | A1 | 11/2005 | Dupeux et al. | |

FOREIGN PATENT DOCUMENTS

| | | | |
|---|---|---|---|
| EP | 1 026 366 | A1 | 8/2000 |
| EP | 1026366 | A1 * | 8/2000 |
| EP | 1 211 383 | | 6/2002 |
| EP | 1 420 144 | A2 | 5/2004 |
| EP | 1 467 063 | | 10/2004 |

(Continued)

OTHER PUBLICATIONS

Mar. 15, 2011 Search Report issued in European patent application No. EP 06 25 6507.

*Primary Examiner* — David Bryant
*Assistant Examiner* — Christopher Besler
(74) *Attorney, Agent, or Firm* — Oliff PLC

(57) ABSTRACT

An aerofoil assembly, for example a bladed rotor assembly (40B) comprises a rotor (42) carrying a plurality of rotor blades (44), at least one of the rotor blades (44) having a coating (46) on the surface of the rotor blade (44). At least one of the rotor blades (44) has a coating (46) having a different thickness, a different area of contact with the surface of the rotor blade (44), a different position of contact on the surface of the rotor blade (44), a different shape of contact on the surface of the rotor blade (44) and/or a different composition compared to at least one of the other rotor blades (44). The coating (46) is applied in a non-uniform manner to reduce the vibration level of the rotor blade (44), or rotor blades (44), with the highest vibration response for a given excitation by changing the bladed rotor assembly (40B) mode shapes and the relative vibration of the rotor blades (44).

32 Claims, 2 Drawing Sheets

(56) References Cited

FOREIGN PATENT DOCUMENTS

| | | | |
|---|---|---|---|
| EP | 1 580 293 | A2 | 9/2005 |
| GB | 1 177 665 | A | 1/1970 |
| GB | 1 478 069 | A | 6/1977 |
| GB | 1 550 597 | A | 8/1979 |
| GB | 2 346 415 | A | 8/2000 |
| WO | WO 03/062606 | | 7/2003 |
| WO | WO 2004/046414 | A2 | 6/2004 |

* cited by examiner

AEROFOIL ASSEMBLY AND A METHOD OF MANUFACTURING AN AEROFOIL ASSEMBLY

The present invention relates to an aerofoil assembly for example a bladed rotor assembly or a stator vane assembly and in particular to a bladed rotor assembly or a stator vane assembly for a turbomachine, for example a bladed rotor assembly or a stator vane assembly for a gas turbine engine. The bladed rotor assembly may comprise a bladed turbine rotor assembly, a bladed compressor rotor assembly or a bladed fan rotor assembly. The stator vane assembly may comprise a turbine stator vane assembly, a compressor stator vane assembly or a fan stator assembly.

It is known to provide a hard coating on a rotor blade assembly of a gas turbine engine. The hard coating has been provided as a thermal barrier coating on the aerofoil and platform, of a turbine rotor blade, as is well known to those skilled in the art. The hard coating has been provided as a vibration damping coating on the aerofoil of a fan rotor blade, or a compressor rotor blade, for example as disclosed in US patent U.S. Pat. No. 3,758,233, published European patent applications EP1026366A1, EP1420144A2, EP1580293A2 and published International patent application WO2004/046414A2.

The hard coating for a thermal barrier coating generally comprises a metallic bond coating on the aerofoil of the rotor blade and a ceramic coating on the metallic bond coating. Similarly the vibration damping coating generally comprises a metallic bond coating on the aerofoil of the rotor blade and a ceramic coating on the metallic bond coating.

The hard coating for vibration damping is generally applied to the whole of the exterior surface of the aerofoil, of all of the rotor blades or to particular areas of the exterior surface of the aerofoil of all of the rotor blades, which are subject to high stresses due to vibration. The hard coating for vibration damping is applied to the rotor blades with the intent to increase the overall damping of one, or more, modes of vibration.

However, each rotor blade in a bladed rotor assembly in general vibrates with a different level of response for a given excitation. The level of difference in vibration response across the rotor blades may be very significant due to physical differences in the rotor blades, or blade connecting structure, e.g. rotor disc, even though the physical differences may be small. The physical differences may be due to imperfect manufacturing processes producing differences in the exact geometry of the rotor blades, may be due to differences in positioning of the rotor blades and/or due to non-uniformity of the mass, or stiffness, of the material used to manufacture the rotor blades.

In general it is the rotor blade, or rotor blades, with the highest vibration response to excitation, which limits the life of the bladed rotor assembly.

Accordingly the present invention seeks to provide a novel aerofoil assembly, which reduces, preferably overcomes, the above-mentioned problem.

Accordingly the present invention provides an aerofoil assembly comprising a structure carrying a plurality of aerofoils, the aerofoils having physical differences, at least one of the aerofoils having added material on, or material removed from, a surface of the aerofoil, wherein at least one of the aerofoils having added material on, or material removed from, the surface of the at least one aerofoil differently compared to at least one of the other aerofoils.

Preferably the aerofoil assembly comprises a bladed rotor assembly comprising a rotor carrying a plurality of rotor blades, the rotor blades having physical differences, at least one of the rotor blades having added material on, or material removed from, a surface of the rotor blade, wherein at least one of the rotor blades having added material on, or material removed from, the surface of the at least one rotor blade differently compared to at least one of the other rotor blades.

Alternatively the aerofoil assembly comprises a stator vane assembly comprising a stator carrying a plurality of stator vanes, the stator vanes having physical differences, at least one of the stator vanes having added material on, or material removed from, a surface of the stator vane, wherein at least one of the stator vanes having added material on, or material removed from, the surface of the at least one stator vane differently compared to at least one of the other stator vanes.

Preferably the bladed rotor assembly comprising a rotor carrying a plurality of rotor blades, the rotor blades having physical differences, at least one of the rotor blades having a coating on the surface of the rotor blade, at least one of the rotor blades having a coating having a different thickness, a different area of contact with the surface of the rotor blade, a different position of contact on the surface of the rotor blade, a different shape of contact on the surface of the rotor blade and/or a different composition compared to at least one of the other rotor blades.

Preferably a plurality of the rotor blades having a coating.

Preferably all of the rotor blades having a coating.

Preferably a plurality of the rotor blades having a coating having a different thickness, a different area of contact with the surface of the rotor blade, a different position of contact on the surface of the rotor blade, a different shape of contact on the surface of the rotor blade and/or a different composition compared to at least one of the other rotor blades.

Preferably a plurality of the rotor blades having a coating having a different thickness, a different area of contact with the surface of the rotor blade, a different position of contact on the surface of the rotor blade, a different shape of contact on the surface of the rotor blade and/or a different composition compared to a plurality of the other rotor blades.

Preferably each of the rotor blades having a coating having a different thickness, a different area of contact with the surface of the rotor blade, a different position of contact on the surface of the rotor blade, a different shape of contact on the surface of the rotor blade and/or a different composition compared to all of the other rotor blades.

Preferably the rotor carrying a plurality of radially outwardly extending rotor blades.

Preferably the rotor blades being integral with the rotor. Preferably the rotor blades being friction welded, laser welded or diffusion bonded to the rotor. Alternatively the rotor blades and rotor being machined from a solid member.

Alternatively the rotor blades having roots, the rotor having a plurality of slots in the periphery of the rotor and the roots of the rotor blades locating in the slots in the periphery of the rotor.

Preferably the rotor is a disc or a drum.

Preferably the rotor is a fan rotor, a compressor rotor or a turbine rotor.

Preferably the coating comprising a metallic bond coating and a ceramic coating. Preferably the metallic bond coating comprising a MCrAlY coating, a MCrAl coating, a MCr coating, an aluminide coating, a platinum aluminide coating, a diffused platinum coating or a diffused chromium coating.

Preferably the ceramic coating comprises zirconia or magnesia-alumina spinel.

The coating may be applied to an external surface or an internal surface of a hollow rotor blade.

It may be possible to have one or more aerofoils with material removed from the surface of the aerofoils and to have one or more aerofoils with material added to the surface of the aerofoils on the structure.

The present invention provides a method of manufacturing an aerofoil assembly comprising forming a structure carrying a plurality of aerofoils, the aerofoils having physical differences, characterised by exciting and measuring the vibration behaviour of each aerofoil, analysing the vibration behaviour of each aerofoil, determining where to add material to, or remove material from, the surface of at least one of the aerofoils of the aerofoil assembly in a non-uniform manner to reduce the vibration level of the aerofoil, or aerofoils, with the highest vibration for the given excitation by changing the aerofoil assembly mode shapes and the relative vibration of the aerofoils.

The method may comprise adding material on, or removing material from, the surface of at least one of the aerofoils differently compared to at least one of the other aerofoils.

The method may comprise forming a stator vane assembly comprising a structure carrying a plurality of stator vanes, the stator vanes having physical differences, adding material on, or removing material from, the surface of at least one of the stator vanes differently compared to at least one of the other stator vanes.

Preferably the method comprises manufacturing a bladed rotor assembly comprising forming a rotor carrying a plurality of rotor blades, the rotor blades having physical differences, adding material on, or removing material from, the surface of at least one of the rotor blades differently compared to at least one of the other rotor blades.

Preferably the present invention provides a method of manufacturing a bladed rotor assembly comprising forming a rotor carrying a plurality of rotor blades, the rotor blades having physical differences, applying a coating on the surface of at least one of the rotor blades, applying a coating on the surface of at least one of the rotor blades such that the coating having a different thickness, a different area of contact with the surface of the rotor blade, a different position of contact on the surface of the rotor blade and/or a different shape of contact on the surface of the rotor blade compared to at least one of the other rotor blades.

Preferably applying a coating to a plurality of the rotor blades.

Preferably applying a coating to all of the rotor blades.

The method may comprise applying a coating to all of the surfaces of all of the rotor blades and removing coating from at least one of the rotor blades.

The method may comprise applying a coating on a surface of a plurality of the rotor blades, the coating on the plurality of rotor blades having a different thickness, a different area of contact with the surface of the rotor blade, a different position of contact on the surface of the rotor blade, a different shape of contact on the surface of the rotor blade and/or a different composition compared to at least one of the other rotor blades.

The method may comprise applying a coating on a surface of a plurality of the rotor blades, the coating on the plurality of rotor blades having a different thickness, a different area of contact with the surface of the rotor blade, a different position of contact on the surface of the rotor blade, a different shape of contact on the surface of the rotor blade and/or a different composition compared to a plurality of the other rotor blades.

The method may comprise applying a coating on a surface of each of the rotor blades, the coating on each of the rotor blades having a different thickness, a different area of contact with the surface of the rotor blade, a different position of contact on the surface of the rotor blade, a different shape of contact on the surface of the rotor blade and/or a different composition compared to all of the other rotor blades.

The method may comprise exciting each individual rotor blade and measuring the vibration behaviour of the individual rotor blade before assembling the rotor blades into the bladed rotor assembly.

The method may comprise constraining of all the rotor blades except for one unrestrained rotor blade, exciting the unrestrained rotor blade, measuring the vibration behaviour of the unrestrained rotor blade and repeating for each rotor blade.

The method may comprise constraining the rotor so as to minimise rotor blade interaction, exciting the rotor blades and measuring the vibration behaviour of each rotor blade.

The method may comprise analysing the measured vibration behaviour of the rotor blades, determining where to apply coatings to the rotor assembly such that the coating is applied in a non-uniform manner to reduce the vibration level of the rotor blade, or rotor blades, with the highest vibration response for a given excitation by changing the rotor assembly mode shapes and the relative vibration of the rotor blades.

Preferably the rotor carrying a plurality of radially outwardly extending rotor blades.

Preferably the rotor blades being integral with the rotor. Preferably the rotor blades being friction welded, laser welded or diffusion bonded to the rotor. Alternatively the rotor blades and rotor being machined from a solid member.

Alternatively the rotor blades having roots, the rotor having a plurality of slots in the periphery of the rotor and the roots of the rotor blades locating in the slots in the periphery of the rotor.

Preferably the rotor is a disc or a drum.

Preferably the rotor is a fan rotor, a compressor rotor or a turbine rotor.

Preferably the coating comprising a metallic bond coating and a ceramic coating. Preferably the metallic bond coating comprising a MCrAlY coating, a MCrAl coating, a MCr coating, an aluminide coating, a platinum aluminide coating, a diffused platinum coating or a diffused chromium coating.

Preferably the ceramic coating comprising zirconia or magnesia-alumina spinel.

The coating may be applied by plasma spraying, air plasma spraying, vacuum plasma spraying, physical vapour deposition, chemical vapour deposition or plating and diffusion heat treatment.

The coating may be applied to an external surface or an internal surface of a hollow rotor blade.

It may be possible to remove material from the surface of one or more aerofoils and to add material to the surface of one or more aerofoils on the structure.

The present invention will be more fully described by way of example with reference to the accompanying drawings in which:—

Figure 1:
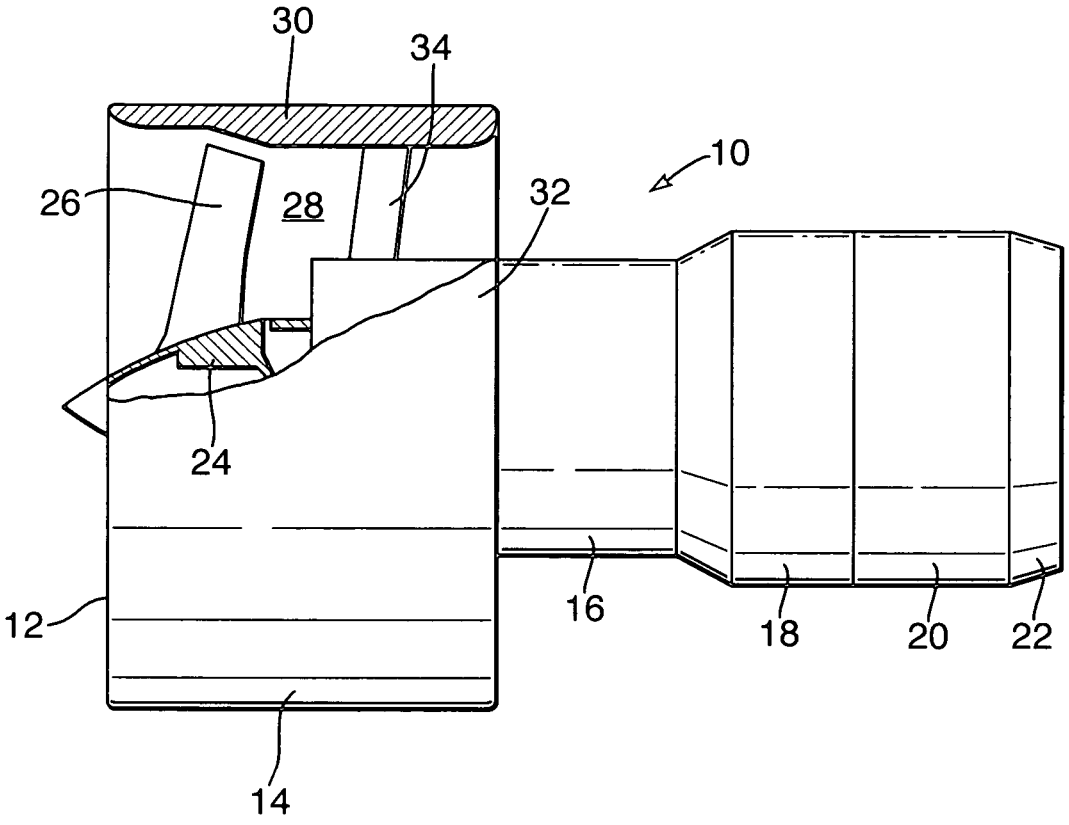
FIG. 1 shows a turbofan gas turbine engine having a rotor blade assembly according to the present invention.

A turbofan gas turbine engine 10, as shown in FIG. 1, comprises in flow series an intake 12, a fan section 14, a compressor section 16, a combustion section 18, a turbine section 20 and an exhaust 22. The fan section 14 comprises a fan rotor 24 carrying a plurality of circumferentially spaced radially outwardly extending fan rotor blades 26. The fan rotor blades 26 are arranged in a fan duct 28 defined partially by a fan casing 30 surrounding the fan rotor 24 and fan rotor blades 26. The fan casing 30 is secured to a core engine casing 32 by a plurality of circumferentially spaced radially extending fan outlet guide vanes 34 which are secured to the fan casing 30 and the core engine casing 32. The compressor section 16 comprises at least one compressor rotor carrying a plurality of circumferentially spaced radially outwardly extending compressor rotor blades, not shown. The turbine section 20 comprises a plurality of turbine rotors each of which carries a plurality of circumferentially spaced radially outwardly extending turbine rotor blades, not shown. A low-pressure turbine rotor, not shown, is arranged to drive the fan rotor 24 via a shaft, not shown, and a high-pressure turbine rotor, not shown, is arranged to drive a high-pressure compressor rotor, not shown, via a shaft, not shown. The turbofan gas turbine engine 10 operates conventionally and its operation will not be discussed further.

As mentioned previously, each rotor blade in a bladed rotor assembly in general vibrates with a different level of response for a given excitation. The level of difference in vibration response across the rotor blades may be very significant due to physical differences in the rotor blades, even though the physical differences may be small. The physical differences may be due to imperfect manufacturing processes producing differences in the exact geometry of the rotor blades, may be due to differences in positioning of the rotor blades and/or due to non-uniformity of the mass, or stiffness, of the material used to manufacture the rotor blades. The rotor blade, or rotor blades, with the highest vibration response to excitation, limits the life of the bladed rotor assembly.

The present invention seeks to modify the actual mode shape, or mode shapes, of the mode, or modes, of vibration in order to reduce the response of the rotor blade, or rotor blades, with the highest vibration response to excitation. Since it is generally the rotor blade, or rotor blades, with the highest vibration response, which limit the life of the bladed rotor assembly, the present invention provides a means of obtaining a more robust bladed rotor assembly even though the level of damping is not too different, although some additional benefit may also result from the damping of the hard coating.

The present invention applies hard coatings to rotor blades of the bladed rotor assembly so that the collective vibration characteristics of the bladed rotor assembly of vibrationally interacting rotor blades is improved. Specifically, hard coatings are applied to the bladed rotor assembly such that the rotor blade, or rotor blades, with the highest vibration response respond with a reduced level for a given excitation. The effect of the hard coatings is to intentionally change the mass and/or the stiffness and/or the damping and/or the aero-coupling between the rotor blades of the bladed rotor assembly in a non-uniform manner thereby beneficially changing the vibration response pattern across the bladed rotor assembly. The main effect with current materials is believed to be due to changes in the mass and/or the stiffness but the influence of changes of the damping or of the aero-coupling between the rotor blades or friction may be more important with newer materials with different characteristics.

The effect of the physical differences between the rotor blades is assessed by testing and measuring the vibration behaviour of the bladed rotor assembly and/or by testing and measuring the vibration behaviour of the individual rotor blades. The testing and measuring of the vibration behaviour of the bladed rotor assembly requires determination of the characteristics of the bladed rotor assembly. These characteristics may be measured, or estimated a number of ways.

For bladed rotor assemblies comprising a plurality of separate rotor blades in which the roots of the rotor blades are located in one or more slots in the periphery, or rim, of the rotor, each individual rotor blade may be separately tested via standard vibration tests, well known to those skilled in the art, to measure the vibration behaviour of the individual rotor blade. There may be a single slot extending circumferentially around the periphery of the rotor into which the roots of all of the rotor blades are located or a plurality of axially extending slots spaced apart circumferentially around the periphery of the rotor and the root of each rotor blade is located in a respective one of the slots.

For bladed rotor assemblies comprising a plurality of rotor blades integral with the periphery, or rim, of the rotor, it is necessary to perform alternative tests. The rotor blades of the integrally bladed rotor are either friction welded, laser welded or diffusion bonded to the rotor or alternatively the rotor blades and the rotor have been machined from a solid member. These alternative tests may be (a) the FMM ID method by J Griffin at Carnegie Mellon, USA, (b) the approach of sequential constraining of all the rotor blades except the one being excited to measure the vibration behaviour of the unrestrained rotor blade and repeat for each rotor blade and (c) the approach of constraining the rotor so as to minimise rotor blade interaction to measure the vibration behaviour of each rotor blade, or to measure the vibration behaviour of each rotor blade and an adjacent sector of the rotor.

The measured vibration response data for the bladed assembly and the measured vibration response data for the individual rotor blades may be used, analysed, in a mathematical model. The mathematical model of the bladed assembly uses all known design information and the measured vibration response data of each individual rotor blade to determine where to apply hard coatings to the bladed assembly. The mathematical model may be used to decide, e.g. to determine, where to apply hard coatings to the bladed rotor assembly such that the hard coating is applied in a non-uniform manner to reduce the vibration level of the rotor blade, or rotor blades, with the highest vibration response for a given excitation by changing the mistuned bladed rotor assembly mode shapes and the relative vibration of the rotor blades. The mathematical model may be used to consider one or more modes of vibration to optimise against particular requirements, for example a particular engine order excitation may be particularly severe and effect particular modes of vibration so that more importance is given to these modes of vibration than other modes of vibration.

The mathematical model may be a simple reduced order model or a complicated finite element representation of the structure of the bladed rotor assembly.

The hard coating is applied in a non-uniform manner to reduce the vibration level of the rotor blade, or rotor blades, with the highest vibration response for a given excitation by changing the bladed rotor assembly mode shapes and the relative vibration of the rotor blades. The hard coating is applied in a non-uniform manner to the bladed rotor assembly and this entails applying the hard coating to one or more of the rotor blades and applying the hard coating differently to at least one of the rotor blades compared to the other rotor blades. The key point is that one of the rotor blades of the bladed rotor assembly is coated differently to one or more of the other rotor blades of the bladed rotor assembly such that the mistuning pattern is changed in a beneficial way by reducing the vibration response level of the highest responding rotor blade, or rotor blades, for a given excitation. The effect of the non-uniform hard coating application is to change the mass and/or stiffness and/or damping distribution of at least one rotor blade and thus change the mistuned vibration patterns. The other potential effect is to change the aero-coupling between rotor blades, which may change the mistuned vibration patterns. In general, the mathematical model for the bladed rotor assembly suggests that the optimum solution involves applying the hard coating to all of the rotor blades in a non-uniform manner, i.e. each rotor blade has the hard coating applied differently.

The optimisation process also considers other issues such as rotor mass balance. The hard coating may also reduce the overall vibration level as well as reduce the vibration level for the rotor blade, or rotor blades, with the highest vibration response.

The application of the hard coating to the rotor blades may result in a mistuned bladed rotor assembly becoming a near tuned bladed rotor assembly. The application of the hard coating to the rotor blades more frequently results in a different mistuned bladed rotor assembly. A near tuned bladed rotor assembly is a bladed rotor assembly in which all the rotor blades vibrate with the same response level for a given excitation.

Thus according to the present invention it will be appreciated that because each bladed rotor assembly is physically different from each other bladed rotor assembly, although if only by small physical differences, the non-uniform hard coating applied to each bladed rotor assembly will be different to all other bladed rotor assemblies.

The bladed rotor assembly may be a fan rotor, a compressor rotor or a turbine rotor.

The hard coating may comprise a metallic bond coating and a ceramic coating. The metallic bond coating may comprise a MCrAlY coating, a MCrAl coating, a MCr coating, an aluminide coating, a platinum aluminide coating, a diffused platinum coating or a diffused chromium coating. The ceramic coating may comprise zirconia or magnesia-alumina spinel.

The coating may be applied by plasma spraying, air plasma spraying, vacuum plasma spraying, physical vapour deposition e.g. electron beam physical vapour deposition, chemical vapour deposition, plating and diffusion heat treatment and other suitable methods.

EXAMPLE

Figure 2:
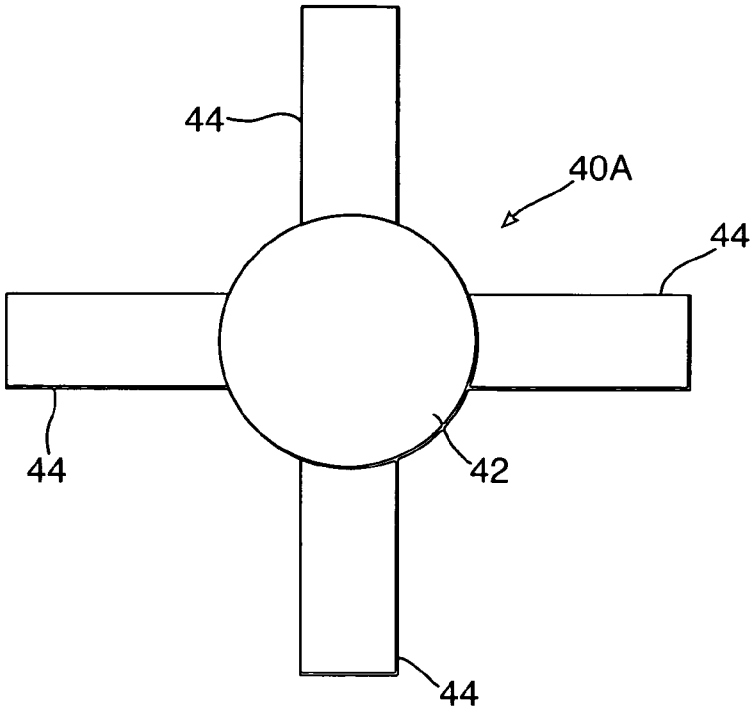
FIG. 2 shows an enlarged view of a bladed rotor assembly according to the prior art.

An integrally bladed rotor assembly 40A, as shown in FIG. 2, comprises a rotor 42 carrying four circumferentially spaced radially outwardly extending rotor blades 44. Suppose that the second bending mode is of particular interest and it is desired to reduce the vibration level of the highest response rotor blade 44 to the engine order exciting the second bending mode. Each manufactured integrally bladed rotor assembly 40A, e.g. an integrally bladed disk, an integrally bladed ring, an integrally bladed drum or an integrally bladed rotor is tested to determine the individual rotor blade 44, or rotor blade 44 and sector of the rotor 42, vibration characteristics.

In so far as mistuning interaction between rotor blades 44 is concerned, suppose that the individual rotor blade 44 alone frequencies define the differences adequately and that these are f1, f2, f3 and f4 (Hz). Under engine order excitation the rotor blades 44 might respectively respond with peak amplitudes A1, A2, A3 and A4 respectively, of which the amplitude of the third rotor blade 44 is the highest. Using a mathematical model of the integrally bladed rotor assembly 40A, using all known design information and the rotor blade 44 alone measured vibration characteristics, the position and extent of the selective hard coating application may be determined and the individual rotor blade 44 alone frequencies is changed such that the response level of the third rotor blade 44 is reduced. The vibration level of the other rotor blades 44 may of course increase, but this is acceptable as long as the highest vibration level in the modified integrally bladed rotor assembly 40B is less than the vibration level A3 of the unmodified integrally bladed disk assembly 40A.

Figure 3:
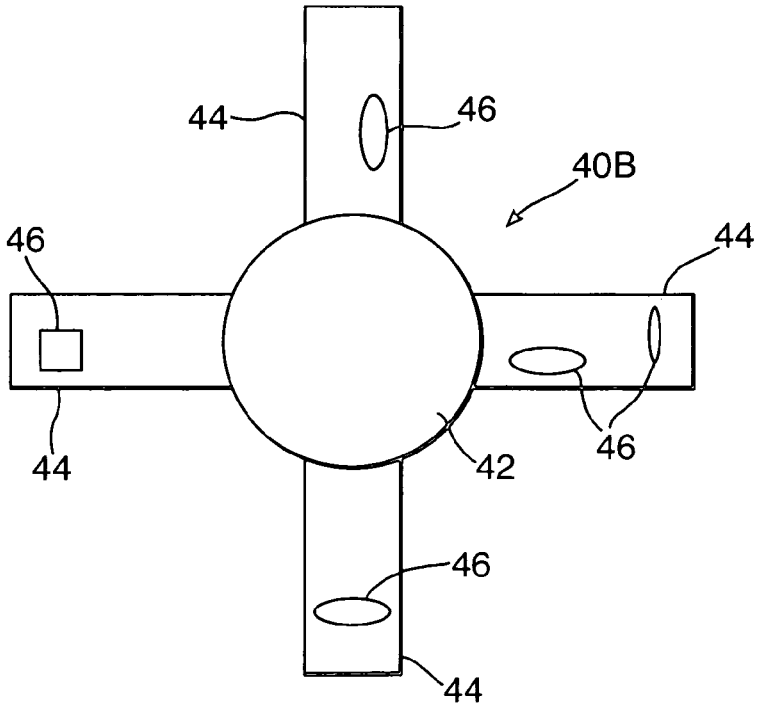
FIG. 3 shows an enlarged view of a bladed rotor assembly according to the present invention.

A modified bladed rotor assembly 40B according to the present invention, as shown in FIG. 3, comprises a rotor 42 carrying four circumferentially spaced radially outwardly extending rotor blades 44, but with a non-uniform application of a hard coating 46 to the rotor blades 44. The hard coating 44 is applied differently on the four rotor blades 44, thus the hard coating 46 is applied as one or more patches on the surface of each aerofoil of the rotor blades 44. The patches of hard coating 46 are arranged to have different surface areas, different shapes, different positions, different thickness and/or different coatings. The hard coating 46 is applied to an outer surface of the rotor blades 44, but may be equally well be applied to an inner surface of the rotor blades if they are hollow rotor blades.

Although the present invention has been described with reference to the application of the hard coating to parts of the surfaces of the rotor blades it may also be possible to apply the hard coating to all of the surfaces of all of the rotor blades and to remove the hard coating from at least one of the rotor blades or to remove different amounts of the hard coating from different rotor blades to achieve the same effect.

Although the present invention has been described with reference to the application of hard coatings to the rotor blades, it is equally possible to apply other suitable coatings as long as one of the rotor blades of the bladed rotor assembly is coated differently to one or more of the other rotor blades of the bladed rotor assembly such that the mistuning pattern is changed in a beneficial way by reducing the vibration response level of the highest responding rotor blade, or rotor blades, for a given excitation.

Although the present invention has been described with reference to the application of a coating to the rotor blades, it may also be possible to selectively remove material from at least one of the rotor blades to achieve the same effect or to remove different amounts of material from all of the rotor blades.

The material may be added to, or removed from, the rotor blades of a bladed rotor assembly at the time of manufacture of a new bladed rotor assembly or at any other time for an existing bladed rotor assembly.

Although the present invention has been described with reference to the application of material, or the removal of material from, the rotor blades of a bladed rotor assembly, it may also be possible to use the same techniques on the stator vanes of a stator vane assembly comprising a stator carrying the stator vanes, the stator may be a casing.

It may be possible to remove material from the surface of one or more aerofoils and to add material to the surface of one or more aerofoils on the structure, for example it may be possible to remove material from the surface of one or more rotor blades and to add material to the surface of one or more rotor blades on the rotor.

I claim:

1. A method of manufacturing an aerofoil assembly comprising the steps of:

(a) forming a structure carrying a plurality of aerofoils, the structure and aerofoils forming the aerofoil assembly, the aerofoils having physical differences, (b) exciting and measuring a vibration behaviour of each aerofoil, (c) exciting and measuring a vibration behaviour of the aerofoil assembly, (d) analysing the vibration behaviour of the aerofoil assembly and the vibration behaviour of the aerofoils, (e) determining where to add material to, or remove material from, a surface of at least one of the aerofoils of the aerofoil assembly in a non-uniform manner to reduce a vibration level of the aerofoil, or aerofoils, with the highest vibration for the given excitation by changing aerofoil assembly mode shapes and a relative vibration of the aerofoils in the aerofoil assembly so that a collective vibration behaviour of the aerofoil assembly of vibrationally interacting aerofoils is improved, and (f) adding material to, or removing material from, the surface of the at least one of the aerofoils of the aerofoil assembly in the determined non-uniform manner to reduce the vibration level of the aerofoil, or aerofoils, with the highest vibration for the given excitation by changing the aerofoil assembly mode shapes and the relative vibration of the aerofoils in the aerofoil assembly so that the collective vibration behaviour of the aerofoil assembly of vibrationally interacting aerofoils is improved, wherein step (b) follows step (a), step (c) follows step (a), step (d) follows steps (b) and (c), step (e) follows step (d), and step (f) follows step (e).

2. A method as claimed in claim 1 further comprising adding material on, or removing material from, the surface of at least one of the aerofoils differently compared to at least one of the other aerofoils.

3. A method as claimed in claim 1, wherein the forming of a structure carrying a plurality of aerofoils includes forming a stator carrying a plurality of stator vanes, the stator vanes having physical differences; and adding material to, or removing material from, the surface of at least one of the aerofoils of the aerofoil assembly includes adding material on, or removing material from, the surface of at least one of the stator vanes differently compared to at least one of the other stator vanes.

4. A method as claimed in claim 1, wherein the forming of a structure carrying a plurality of aerofoils includes forming a rotor carrying a plurality of rotor blades, the rotor blades having physical differences; and adding material to, or removing material from, the surface of at least one of the aerofoils of the aerofoil assembly includes adding material on, or removing material from, the surface of at least one of the rotor blades differently compared to at least one of the other rotor blades.

5. A method as claimed in claim 4 further comprising applying a coating on the surface of at least one of the rotor blades, applying the coating on the surface of the at least one of the rotor blades such that the coating has a different thickness, a different area of contact with the surface of the rotor blade, a different position of contact on the surface of the rotor blade, a different shape of contact on the surface of the rotor blade and/or a different composition compared to at least one of the other rotor blades.

6. A method as claimed in claim 5 further comprising applying the coating to a plurality of the rotor blades.

7. A method as claimed in claim 6 further comprising applying the coating to all of the rotor blades.

8. A method as claimed in claim 5 further comprising applying the coating to all of the surfaces of all of the rotor blades and removing coating from at least one of the rotor blades.

9. A method as claimed in claim 5 further comprising applying the coating on a surface of a plurality of the rotor blades, the coating on the plurality of rotor blades having a different thickness, a different area of contact with the surface of the rotor blade, a different position of contact on the surface of the rotor blade, a different shape of contact on the surface of the rotor blade and/or a different composition compared to at least one of the other rotor blades.

10. A method as claimed in claim 9 further comprising applying the coating on the surface of the plurality of the rotor blades, the coating on the plurality of rotor blades having a different thickness, a different area of contact with the surface of the rotor blade, a different position of contact on the surface of the rotor blade, a different shape of contact on the surface of the rotor blade and/or a different composition compared to a plurality of the other rotor blades.

11. A method as claimed in claim 10 further comprising applying the coating on a surface of each of the rotor blades, the coating on each of the rotor blades having a different thickness, a different area of contact with the surface of the rotor blade, a different position of contact on the surface of the rotor blade, a different shape of contact on the surface of the rotor blade and/or a different composition compared to all of the other rotor blades.

12. A method as claimed in claim 5 further comprising exciting each individual rotor blade and measuring the vibration behaviour of the individual rotor blade before assembling the rotor blades into the rotor assembly.

13. A method as claimed in claim 5 further comprising constraining all of the rotor blades except for one unrestrained rotor blade, exciting the unrestrained rotor blade, measuring the vibration behaviour of the unrestrained rotor blade and repeating for each rotor blade.

14. A method as claimed in claim 5 further comprising constraining the rotor so as to minimise rotor blade interaction, exciting the rotor blades and measuring the vibration behaviour of each rotor blade.

15. A method as claimed in claim 5 further comprising analysing the measured vibration behaviour of the rotor blades, determining where to apply coatings to the rotor assembly such that the coating is applied in a non-uniform manner to reduce the vibration level of the rotor blade, or rotor blades, with the highest vibration response for a given excitation by changing the bladed rotor assembly mode shapes and the relative vibration of the rotor blades.

16. A method as claimed in claim 5 wherein the rotor carries a plurality of radially outwardly extending rotor blades.

17. A method as claimed in claim 5 wherein the rotor blades are integral with the rotor.

18. A method as claimed in claim 17 further comprising securing the rotor blade using a method selected from the group comprising friction welding, laser welding and diffusion bonding.

19. A method as claimed in claim 17 further comprising machining the rotor blades and rotor from a solid member.

20. A method as claimed in claim 5 wherein the rotor blades have roots, the rotor has a plurality of slots in the periphery of the rotor and the roots of the rotor blades are located in the slots in the periphery of the rotor.

21. A method as claimed in claim 5 wherein the rotor is selected from the group comprising a disc and a drum.

22. A method as claimed in claim 5 wherein the rotor is selected from the group comprising a fan rotor, a compressor rotor and a turbine rotor.

23. A method as claimed in claim 5 wherein the coating comprises a metallic bond coating and a ceramic coating.

24. A method as claimed in claim 23 wherein the metallic bond coating is selected from the group comprising a MCrAlY coating, a MCrAl coating, a MCr coating, an aluminide coating, a platinum aluminide coating, a diffused platinum coating and a diffused chromium coating.

25. A method as claimed in claim 23 wherein the ceramic coating is selected from the group comprising zirconia and magnesia-alumina spinel.

26. A method as claimed in claim 5 further comprising applying the coating by a method from the group comprising plasma spraying, air plasma spraying, vacuum plasma spraying, physical vapour deposition, chemical vapour deposition and plating and diffusion heat treatment.

27. A method as claimed in claim 2 further comprising removing material from the surface of at least one aerofoil and adding material to the surface of the at least one aerofoil on the structure.

28. A method as claimed in claim 1 further comprising providing a mathematical model of the bladed assembly, the mathematical model having design information of the bladed assembly and the vibration behaviour of each aerofoil, using the mathematical model to determine where to add material to, or remove material from, the surface of the at least one of the aerofoils.

29. A method as claimed in claim 1 further comprising considering more than one mode of vibration and giving more importance to a particular mode of vibration than other modes of vibration.

30. A method as claimed in claim 28 further comprising selecting the mathematical model from the group consisting of a reduced order model representation of the structure of the aerofoil assembly and a finite element representation of the structure of aerofoil assembly.

31. A method of manufacturing an aerofoil assembly comprising the steps of:

(a) forming a structure carrying a plurality of aerofoils, the structure and aerofoils forming the aerofoil assembly, the aerofoils having physical differences, (b) exciting and measuring a vibration behaviour of the aerofoil assembly, (c) analysing a vibration behaviour of the aerofoil assembly, (d) determining where to add material to, or remove material from, a surface of at least one of the aerofoils of the aerofoil assembly in a non-uniform manner to reduce a vibration level of the aerofoil, or aerofoils, with the highest vibration for the given excitation by changing aerofoil assembly mode shapes and a relative vibration of the aerofoils in the aerofoil assembly so that a collective vibration behaviour of the aerofoil assembly of vibrationally interacting aerofoils is improved, and (e) adding material to, or removing material from, the surface of the at least one of the aerofoils of the aerofoil assembly in the determined non-uniform manner to reduce the vibration level of the aerofoil, or aerofoils, with the highest vibration for the given excitation by changing the aerofoil assembly mode shapes and the relative vibration of the aerofoils in the aerofoil assembly so that the collective vibration behaviour of the aerofoil assembly of vibrationally interacting aerofoils is improved, wherein step (b) follows step (a), step (c) follows step (a), step (d) follows steps (b) and (c), and step (e) follows step (d).

32. A method of manufacturing an aerofoil assembly comprising the steps of:

(a) forming a structure carrying a plurality of aerofoils, the structure and aerofoils forming the aerofoil assembly, the aerofoils having physical differences, (b) exciting and measuring a vibration behaviour of each aerofoil, (c) analysing a vibration behaviour of the aerofoils, (d) determining where to add material to, or remove material from, a surface of at least one of the aerofoils of the aerofoil assembly in a non-uniform manner to reduce a vibration level of the aerofoil, or aerofoils, with the highest vibration for the given excitation by changing aerofoil assembly mode shapes and a relative vibration of the aerofoils in the aerofoil assembly so that a collective vibration behaviour of the aerofoil assembly of vibrationally interacting aerofoils is improved, and (e) adding material to, or removing material from, the surface of the at least one of the aerofoils of the aerofoil assembly in the determined non-uniform manner to reduce the vibration level of the aerofoil, or aerofoils, with the highest vibration for the given excitation by changing the aerofoil assembly mode shapes and the relative vibration of the aerofoils in the aerofoil assembly so that the collective vibration behaviour of the aerofoil assembly of vibrationally interacting aerofoils is improved, wherein step (b) follows step (a), step (c) follows step (a), step (d) follows steps (b) and (c), and step (e) follows step (d).

* * * * *